United States Patent [19]

Myers

[11] Patent Number: 4,810,110

[45] Date of Patent: Mar. 7, 1989

[54] FORM THICKNESS COMPENSATOR WITH CUTTER

[75] Inventor: Charles M. Myers, Park City, Mont.

[73] Assignee: Micro Peripherals, Inc., San Diego, Calif.

[21] Appl. No.: 103,133

[22] Filed: Sep. 28, 1987

[51] Int. Cl.[4] ..... B41J 11/20; B41J 11/68

[52] U.S. Cl. ..... 400/58; 400/56; 400/621; 400/185; 400/328

[58] Field of Search ..... 400/55, 56, 57, 58, 400/59, 60, 185, 187, 320, 322, 356, 621

[56] References Cited

U.S. PATENT DOCUMENTS 4,544,293 10/1985 Cranston et al. ..... 400/621

FOREIGN PATENT DOCUMENTS 84690 6/1980 Japan ..... 400/59
145175 8/1984 Japan ..... 400/185
27272 2/1986 Japan ..... 400/356
125872 6/1986 Japan ..... 400/187

OTHER PUBLICATIONS

D. F. Colglazier et al., "Print Head Control Apparatus"; *IBM Tech. Disc. Bull.; vol. 17, No. 4, pp. 1186–1187; Sep. 1974.*

R. H. Hams; "Print-Transpose-Driven Paper Guillotine;" *IBM Tech. Disc. Bull.;* vol. 26, No. 8, pp. 4188–4189, Jan. 1984.

*Primary Examiner*—David A. Wiecking
*Attorney, Agent, or Firm*—Watts, Hoffmann, Fisher & Heinke Co.

[57] ABSTRACT

A printer mechanism including a frame, a platen, a printhead, a compensator mechanism supported on a frame and movable relative thereto to compensate for print media of various thicknesses, a drive motor for driving the printhead rotatable in the first direction to drive the printhead and rotatable in the second direction and a sector gear connected to the compensator mechanism for effecting movement of the compensator mechanism to move the platen supported thereby away from the printhead. The drive motor when rotated in the second direction is effective to drive the sector gear to move the compensator mechanism to move the platen to a position in which it is spaced apart from the printhead.

9 Claims, 3 Drawing Sheets

FORM THICKNESS COMPENSATOR WITH CUTTER

DESCRIPTION

A form thickness compensator for a printer mechanism.

TECHNICAL FIELD

The present invention relates to a printer mechanism which includes a form thickness compensator for adjusting the distance between the printhead and the platen to compensate for forms of varying thickness and a cutter mechanism. The cutter mechanism and the form thickness compensator are driven from a common drive means.

BACKGROUND OF THE INVENTION

Printer mechanisms and compensating mechanisms therefore are well known in the art. The known printer mechanisms which include compensators do not utilize a cutter mechanism which is driven synchronously with the compensator by a common drive mechanism. An example of a known compensator mechanism is disclosed in U.S. Pat. No. 4,632,577.

The known prior art printer mechanisms suffer from the disadvantage that cumbersome and space consuming compensator mechanisms are utilized and separate drive means are provided for the compensator, cutter mechanism and printhead. This results in a bulky, complicated and expensive printer mechanism.

DISCLOSURE OF THE INVENTION

The printer mechanism of the present invention includes a printhead, a compensator mechanism, a cutter mechanism and a common drive means for synchronously operating the compensator mechanism and the cutter mechanism.

A provision of the present invention is to provide a new and improved printer mechanism including a printhead, a compensator mechanism and a common drive for effecting movement of the printhead and for effecting movement of the compensator mechanism to compensate for print mediums of varying thickness.

Still another provision of the present invention is to provide a new improved printer mechanism including a frame, a platen, a printhead supported by the frame in confronting relationship to the platen for printing on a print medium located between the printhead and the platen, a compensator mechanism supported on the frame and moveable relative thereto, the compensator mechanism supporting the platen for movement therewith toward and away from the printhead to compensate for print mediums of various thickness, a cutter mechanism for cutting the print medium and a drive means for driving the compensator mechanism and the cutter mechanism. The drive means is rotatable in a first direction and rotatable in a second direction to drive the compensator mechanism and the cutter mechanism. The drive means when rotatable in the first direction is inoperable to actuate the cutter mechanism and the compensator mechanism.

Further provision of the present invention is to provide a new and improved printer mechanism including a frame, a platen, a printer supported by the frame in confronting relationship to the platen for printing on a print medium located between the printhead and the platen, a compensator mechanism supporting the platen for movement toward and away from the printhead to compensate for print media of varying thickness, a drive motor for driving the printhead and effecting movement of the compensator mechanism, and a sector gear connected to the compensator mechanism for effecting movement of the compensator mechanism and wherein the drive motor rotates in a first direction for driving the printhead and rotates in a second direction to effect movement of the sector gear to move the compensator mechanism.

DESCRIPTION OF A PREFERRED EMBODIMENT

Figure 1:
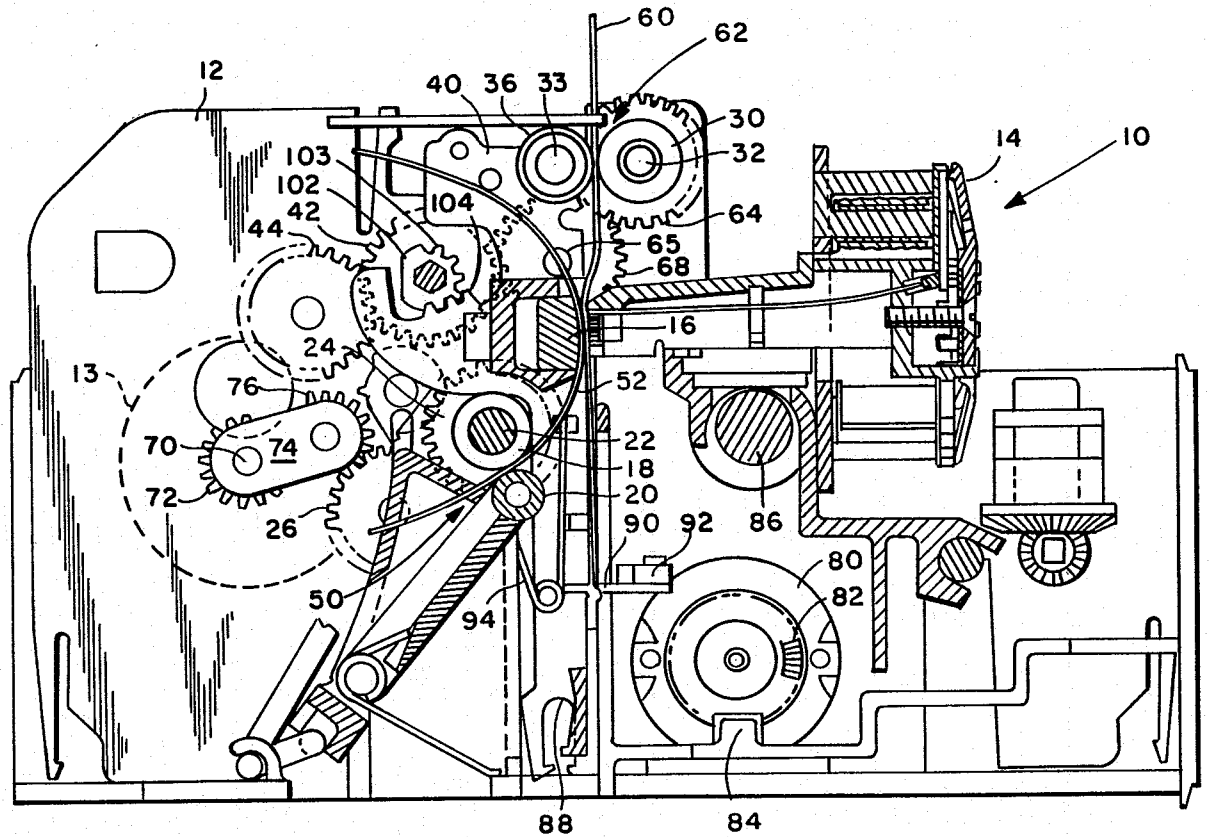
FIG. 1 is a cross-sectional view of the printer mechanism of the present invention taken approximately along the line 1—1 of FIG. 3.

Referring generally to FIG. 1, a printer mechanism 10 is generally disclosed. The printer mechanism 10 is a mechanism which is operable to print on a pair of print media as will be more fully disclosed. The printer mechanism 10 includes a pair of support plates or side walls 12, one of which is disclosed in FIG. 1. The support plates 12 operate to support the drive mechanism and rollers of the printer mechanism 10 as will be more fully described.

The printer mechanism 10 includes a printhead 14 and a platen 16. The printhead 14 is operable to print on a print media which passes over the platen 16. A paper roller 18 is supported on a shaft 22 which in turn is supported by the support plates 12 of the printer mechanism 10. A paper feed gear 24 is disposed on shaft 22 and is operable to drive the paper roller 18. A paper pressure roller 20 is disposed parallel to the paper roller 18 and cooperates therewith to define a nip 50 through which a print media is adapted to pass.

In the preferred embodiment, a supply (not illustrated) of continuous print media such as roll Paper 52 is provided which is directed through the nip 50 between the paper roller 18 and the paper pressure roller 20. When the gear 24 is driven, the continuous paper 52 is driven through the nip 50 and across the surface of the platen 16 where it is adapted to be printed by the printhead 14 in a well known manner.

A paper feed idler gear 26 is supported for rotation on the frame 12 and engages with the paper feed gear 24 to drive paper roller 18. A stepper motor shown in phantom lines at 13 in FIG. 1 is operatively associated with the paper feed idler gear 26 and is operable to effect rotation of paper feed idler gear 26 as will be described more fully hereinbelow.

The printer mechanism 10 is adapted to print on the continuous print medium 52 and is additionally adapted to print either separately or simultaneously on a noncontinuous print medium such as a noncontinuous form 60 which may be inserted between the printhead 14 and platen 16 as will be more fully described hereinbelow. A form feed roller 30 and a form feed pressure roller 36 cooperate to define a nip 62 therebetween through which a form 60 is adapted to be fed. The form feed roller 30 is supported on a shaft 32 which is supported in the sidewalls 12 of the printer mechanism 10. The form feed pressure roller 36 is disposed on shaft 33 which is supported on a compensator mechanism 40 in a position parallel to the form feed roller 30. The form feed pressure roller 36 is adapted to move away from the form feed roller 30 upon pivoting of the compensator mechanism 40 to allow for the insertion of a form 60 in the nip 62 between the form feed pressure roller 36 and the form feed roller 30.

A gear 64 is supported on shaft 32 and is adapted to drive the form feed roller 30. Gear 64 engages with a gear 68 which is supported on a shaft 65 supported on the sidewall 12. The gear 68 is adapted to be driven by a form feed gear 42 which is supported on the compensator drive shaft 102. A form idler gear 44 meshes with the form feed gear 42 and rotation of the form feed idler gear 44 will effect rotation of the form feed gear 42 and gears 68 and 64 to effect rotation of the form feed roller 30 and movement of the form 60 past the printhead 14 and platen 16. The stepper motor 13 is operatively associated with the form idler gear 44 and is operable to effect rotation thereof to drive form feed roller 30 as will be more fully described hereinbelow.

The motor 13, which is supported by the sidewall 12 of the Printer mechanism 10, includes a drive shaft 70. A main drive gear 72 is fixed to the shaft 70 of the drive motor 13 to rotate therewith. An interposer shuttle 74 is supported on the drive shaft 70 of motor 13. The interposer shuttle 74 is free to rotate around the drive motor shaft 70 and supports an interposer idler gear 76 which meshes with and is adapted to be driven by the main drive gear 72. The interposer idler gear 76 is adapted to be selectively engaged with the paper idler gear 26 or the form idler gear 44.

The interposer shuttle 74 is adapted to be rotated about drive shaft 70 to alternately engage with the paper feed idler gear 26 or the form feed idler gear 44 depending upon the direction of rotation of the main drive gear 72. The operation of the interposer shuttle and the driving of the paper feed roller 18 and the form feed roller 30 are more fully disclosed in application Ser. No. 050,114 filed on May 15, 1987 and assigned to the assignee of the present invention which is incorporated herein by reference.

A drive motor 80 is provided to effect movement of the printhead 14 relative to the platen 16. The drive motor 80 effects rotation of a printhead drive cam 86 to effect movement of the printhead 14 relative to the platen 16 in a well-known manner. The drive motor 80 includes a slotted timing disc 82 which is attached to the output shaft of the drive motor 80 and optical sensors 84 are operable to provide a signal indicative of the position of the output shaft of drive motor 80 which in turn is indicative of the position of the printhead 14.

Figure 2:
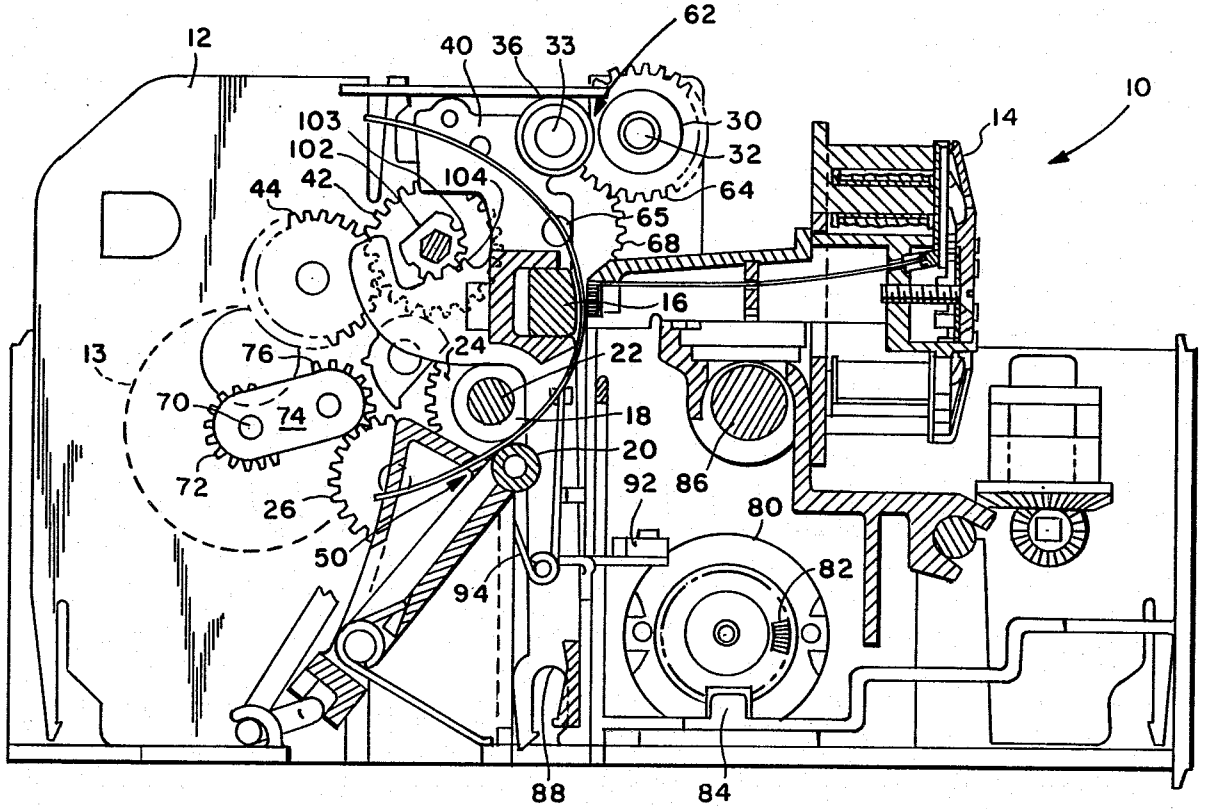
FIG. 2 is a cross-sectional view of the printer mechanism of the present invention which is similar to the view of FIG. 1 except that the compensator mechanism has been moved to a position in which the platen is spaced apart from the printhead to provide for form insertion therebetween.

The compensator mechanism 40 is pivotably supported at point 88 relative to the frame 12 of the printer mechanism 10 and is operable to move from its closed position, illustrated in FIG. 1, to its open position, illustrated in FIG. 2. The compensator mechanism 40 supports form feed pressure roller 36 thereon and positions the form feed pressure roller 36 to define nip 62 between the form feed pressure roller 36 and the form feed roller 30. When it is desired to insert a form to be printed, the compensator mechanism 40 is pivotable in a counterclockwise direction as is viewed in FIG. 1 to its position illustrated in FIG. 2 in which form feed pressure roller 36 and form feed roller 30 are spaced apart. The form 60 is then inserted between form feed pressure roller 36 and form feed roller 30 and between the printhead 14 and platen 16 until it engages with a form feed stop 90. An optical sensor 92 is associated with the form feed stop 90 to sense the presence of a form thereon. When the presence of a form 60 is sensed by the optical sensor 92, the compensator mechanism 40 will be rotated in a clockwise direction as is viewed in FIG. 2 to engage the form feed pressure roller 36 with one side of inserted form 60 and form feed roller 30 with the opposite side of inserted form 60. The compensator mechanism 40 will then automatically compensate for the thickness of the form by controlling the distance between the rollers 36 and 30 and the width of nip 62 therebetween. The engagement of rollers 36 and 30 with opposite sides of an inserted form 60 will automatically set the distance between the printhead 14 and the platen 16 which is carried by the compensator mechanism 14. A torsion spring 94 biases the compensator mechanism 40 in a clockwise direction as is viewed in FIG. 1 to close the compensator mechanism 14 after it is opened by actuation of the drive motor 80.

Figure 3:
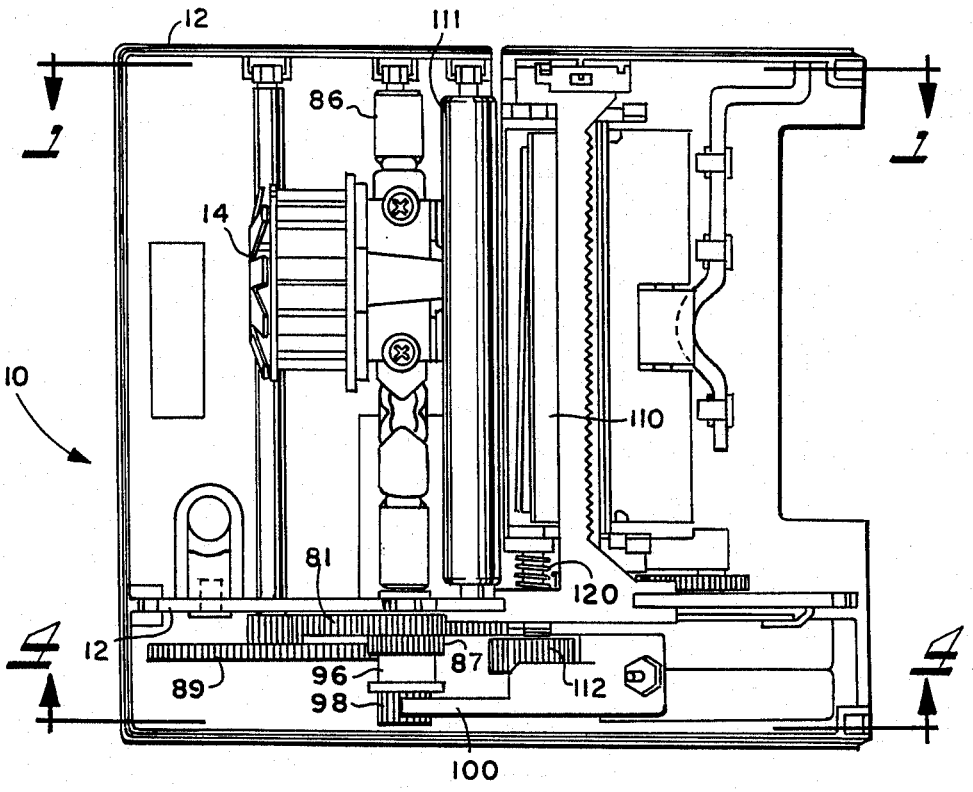
FIG. 3 is a top view of the printer mechanism of FIG. 1 wherein the form pressure roller has been replaced by the cutter mechanism.

During normal printing, the printhead 14 moves in and out of the plane of FIG. 1 being driven by the rotating drive cam 86, more fully illustrated in FIG. 3. The drive cam 86 has a drive gear 81 connected thereto which is driven by drive gear 83 which is connected to the output shaft of motor 80. When motor 80 is energized, gear 83 rotates to drive gear 81 which in turn drives drive cam 86. The drive cam 86 rotates in a counterclockwise direction as is viewed in FIG. 4 to effect movement of the printhead 14 during printing. A one-way roller clutch 96 is located on one end of the drive cam 86 and includes an output gear 98 as the output member thereof. When the cam 86 rotates in a counterclockwise direction as is viewed in FIG. 4, the printhead 14 will move back and forth across the platen 16 and the output member 98 of the one-way clutch 96 will not rotate. When the drive cam 86 is rotated in a clockwise direction as is viewed in FIG. 4, the output gear 98 will rotate clockwise as is viewed in FIG. 4. A gear 87 is also connected to cam 86 for rotation therewith. Gear 87 meshes and drives gear 89 which is part of the ribbon drive, not illustrated, of the printer 10.

The output gear 98 is adapted to mesh with a sector gear 100. The sector gear 100 is supported on a compensator drive shaft 102 which includes a gear 103 supported thereon for rotation therewith and which is connected to the compensator mechanism 40 as is more fully illustrated in FIG. 1. Gear 103 is supported on compensator drive shaft 102 and meshes with gear teeth 104 located on the compensator mechanism 40. Rotation of shaft 102 in a counterclockwise direction as is viewed in FIG. 4 (clockwise as is viewed in FIG. 1), will rotate gear 103 which engages with teeth 104 to effect counterclockwise rotation, as is viewed in FIG. 1, of the compensator mechanism 40 about the pivot point 88 thereby opening the compensator mechanism 40. When the drive cam 86 rotates in a counterclockwise direction as is viewed in FIG. 4, the one-way roller clutch 96 does not transmit motion from the drive cam 86 to the output gear 98 and sector gear 100 will not be rotated thereby. When the drive cam 86 rotates in a clockwise direction as is viewed in FIG. 4, the output gear 98 of the one-way clutch 96 will rotate clockwise with drive cam 86 and will engage and rotate sector gear 100 to rotate drive shaft 102, gear 103 and the compensator mechanism 40. When it is desired to close the compensator mechanism 40, drive cam 86 will rotate in a counterclockwise direction as viewed in FIG. 4 and the compensator mechanism will be biased closed by the spring 94.

When the printer mechanism 10 is printing only on roll paper 52, the compensator mechanism 40 with the attached platen 16 remains in the closed position illustrated in FIG. 1, being biased in a clockwise direction as viewed in FIG. 1 by torsion spring 94. The clockwise orientation of the compensator mechanism 40 is established by the contact of the form drive roller 30 and the form pressure roller 36 as the compensator 40 is biased by the torsion spring 94.

When it is desired to print on an inserted form 60, the compensator mechanism 40 is opened to allow insertion of the form 60 in the nip 62 between the rollers 30, 36. This is accomplished by reversing the direction of rotation of the printhead drive motor 80 so that the drive cam 86 rotates in a clockwise direction as is viewed in FIG. 4. When the drive cam 86 rotates in a clockwise direction, the one-way roller clutch 96 transmits rotary motion from the drive cam 86 to the cam pinion or output gear 98 which in turn rotates the sector gear 100 in a counterclockwise direction as is viewed in FIG. 4. The sector gear 100 engages and rotates the compensator drive shaft 102 and gear 103 to move the compensator mechanism 40 in a counterclockwise direction as is viewed in FIG. 1 to its open position illustrated in FIG. 2.

The amount of clockwise rotation of the compensator mechanism 40 is determined by controlled angular rotation of the printhead drive motor 80. The controlled rotation is accomplished by counting the slots of the slotted timing disc 82 as the slots pass through optical sensor 84. After the compensator mechanism 40 has opened, the form 60 is inserted between the form drive roller 30 and the form pressure roller 36. Insertion of the form 60 continues downward until it contacts the form stop 90 and its presence is sensed by the optical sensor 92.

After the form 60 has been inserted, the compensator mechanism 40 is closed. This can be done either in a manual fashion or by allowing the optical sensor 92 to effect automatic closing of the compensator mechanism 40 when the form 60 is sensed at the form stop 90. This is accomplished by reversing the direction of the printhead drive motor 80 so that the drive cam 86 rotates in a counterclockwise direction as is viewed in FIG. 4, thereby releasing pinion 98 which allows the torsion spring 94 to rotate the compensator 40 in a clockwise direction as is viewed in FIG. 1 until the form pressure roller 36 mounted on the compensator 40 contacts the form drive roller 30 with the inserted form 60 clamped therebetween in a position ready for printing. The thickness of the inserted form may vary from form to form depending upon the number of sheets to be printed. The actual thickness of any given form clamped between the form pressure roller 36 and the form drive roller 30, establishes the gap between the printhead 14 and the platen 16. The thicker the form the greater the gap. Thus, the printhead to platen gap is compensated for the form thickness by the form thickness itself.

After the form 60 is clamped, printing may be accomplished thereon as the form drive roller 30 is driven by the media drive stepper motor 13 via the media drive gear train 72, 76, 44, 42, 68 and 64 which effects rotation of the form feed roller 30 acting against the form pressure roller 36 and the form 60 to advance the form 60 upward during intervals between printing. Printing on an inserted form 60 in this manner is referred to as multiline validation.

Figure 4:
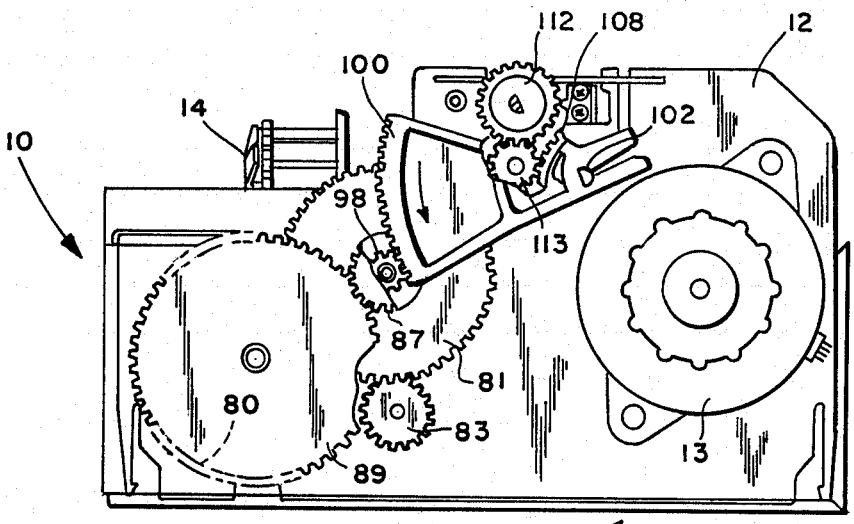
FIG. 4 is a partial cross-sectional view of the printer mechanism taken approximately along the lines 4—4 of FIG. 3.

A roll paper cutter 110 can be associated with the printer mechanism 10 of the present invention. The roll paper cutter 110, more fully illustrated in FIGS. 3 and 4, is located in the same location as the form pressure roller 36 supported by the compensator mechanism 40. When it is desired to utilize a cutting mechanism 110, the form pressure roller 36 is removed and the roll paper cutter 110 is inserted in its place as is illustrated in FIGS. 3 and 4. In addition, a dummy roller 111 is utilized to replace the form drive roller 30 as is more fully shown in FIG. 3.

For the purposes of minimizing size, cost and complexity, the operation of the roll paper cutter 110 is made simultaneous and synchronous with the operation of the compensator mechanism 40. When it is desired to cut the roll paper 52, the printhead drive motor 80 is rotated to rotate the drive cam 86 in a clockwise direction as is viewed in FIG. 4. Rotation of the drive cam 86 in a clockwise direction causes the sector gear 100 to rotate in a counterclockwise direction as is viewed in FIG. 4, to cause the compensator 40 to open. The sector gear 100 includes a second set of teeth 108 thereon which are cutter drive teeth. A cutter idler gear 113 is disposed on the frame 12 and is adapted to mesh with the cutter drive teeth 108 on the sector gear 100 and with a cutter drive gear 112. When it is desired to cut roll paper, the printhead drive motor 80 is rotated to effect rotation of the gear 98 in a clockwise direction as is viewed in FIG. 4 to rotate sector gear 100 in a counterclockwise direction. Rotation of sector gear 100 in a counterclockwise direction enables the cutter drive teeth 108 thereon to engage and rotate the cutter idler gear 113 which in turn effects rotation of the cutter drive gear 112. The rotation of the cutter drive gear 112 effects a cutting action in the cutting mechanism 110 to cut the roll Paper 52 disposed therein. After the cut is completed, the direction of rotation of the printhead drive motor 80 is again reversed. This allows the torsion spring 94 to rotate the compensator 40 in a clockwise direction as is viewed in FIG. 1 into the closed position and it also allows a torsion spring 120 to rotate the cutter drive gear 112 and the rotating blade of the cutter mechanism 110 in a clockwise direction as is viewed in FIG. 4 to return the rotating blade of the cutter mechanism 110 to its unactuated position.

Utilizing the roll paper cutter 110, a form may be inserted into the mechanism and clamped between the dummy roller 111 and the body of the cutter mechanism 110 and held in place for a single line of printing. This is referred to as single line validation. After the printing, the drive motor can be reversed and the form unclamped.

From the foregoing, it should be apparent that a new and improved printer mechanism has been provided which includes a platen 16, a printhead 14 supported in a confronting relationship to the platen for printing on a print medium located between the printhead and the platen, a compensator mechanism 40 supported on the frame 12 and moveable relative thereto, the compensator mechanism supporting the platen 16 for movement toward and away from the printhead 14 to compensate for print media of various thicknesses and a cutter mechanism for cutting the print medium. The printer mechanism includes a drive means for driving the compensator mechanism and the cutter mechanism with the drive means being rotatable in a first direction and a second direction. The drive means when rotatable in the second direction drives the compensator mechanism and the cutter mechanism and when rotatable in the first direction is inoperable to actuate the cutter mechanism and the compensator mechanism.

What is claimed is:

1. A printer mechanism comprising a frame, a platen, a printhead supported by said frame in confronting relationship to said platen for printing on a print medium located between said printhead and said platen, a compensator mechanism supported on said frame and moveable relative thereto, said compensator mechanism supporting said platen thereon for movement therewith toward and away from said printhead to compensate for print media of various thickness, a cutter mechanism including at least a first and a second member which are movable relative to each other to cut said print medium, a drive means for driving said compensator mechanism and said cutter mechanism, said drive means rotatable in a first direction and being rotatable in a second direction, opposite said first direction, to drive said compensator mechanism and to effect relative movement of said first and second member of said cutter mechanism, said drive means when rotatable in said first direction being inoperable to actuate said cutter mechanism and said compensator mechanism.

2. A printer mechanism as defined in claim 1 wherein said drive means further operates to drive said printhead, said drive means when rotatable in said first direction driving said printhead and when rotatable in said second direction synchronously driving said compensator mechanism and said cutter mechanism.

3. A print mechanism as defined in claim 1 wherein said cutter mechanism is supported on said compensator mechanism for movement therewith.

4. A printer mechanism as defined in claim 1 further including a one-way clutch associated with said drive means, said one-way clutch having an output member operatively associated with said compensator mechanism and said cutter mechanism, said drive means when rotating in said first direction being inoperable to actuate said cutter mechanism and said compensator mechanism and when rotating in said second direction effecting rotation of said output member of said one-way clutch to thereby actuate said cutter mechanism and said compensator mechanism.

5. A printer mechanism as defined in claim 1 further including a sector gear supported by said frame and operatively associated with said compensator mechanism and said drive means, said sector gear being rotatable upon rotation of said drive means in said second direction to effect pivotable movement of said compensator mechanism to thereby move said platen supported by said compensator mechanism away from said printhead to provide for insertion of a print media between said platen and said printhead.

6. A printer mechanism as defined in claim 5 wherein said sector gear is further operatively associated with said cutter mechanism, said sector gear when rotated effecting actuation of said cutter mechanism.

7. A printer mechanism comprising a frame, a platen, a printhead supported by said frame in confronting relationship to said platen for printing on a print medium located between said printhead and said platen, a compensator mechanism supported on said frame and moveable relative thereto, said compensator mechanism supporting said platen thereon for movement therewith toward and away from said printhead to compensate for print mediums of varying thickness, a drive motor for driving said printhead, said drive motor rotatable in a first direction to drive said printhead and being rotatable in a second direction, opposite said first direction, a sector gear connected to said compensator mechanism for effecting movement of said compensator mechanism to move said platen supported thereby away from said printhead, said drive motor when rotating in said first direction driving said printhead and being ineffective to drive said compensator mechanism, said drive motor when rotating in said second direction being effective to drive said sector gear to move said compensator mechanism to move said platen supported thereby to a position in which it is spaced apart from said printhead.

8. A printer mechanism as defined in claim 7 further including a cutter mechanism for cutting said print medium, and wherein said compensator mechanism is operatively associated with said cutter mechanism, said compensator mechanism being operable to support said cutter mechanism and to actuate said cutter mechanism when said drive motor is rotated in said second direction and being ineffective to actuate said cutter mechanism when said drive motor is rotated in said first direction.

9. A printer mechanism as defined in claim 8 further including a one-way clutch associated with the output of said drive motor, said drive motor when rotating in said second direction being effective to drive said sector gear through said one-way clutch to move said compensator mechanism.

* * * * *